United States Patent [19]

Brush, Sr. et al.

[11] 4,434,552

[45] Mar. 6, 1984

[54] METHOD OF MAKING A PIN TYPE ELECTRICAL CONNECTOR CONTACT

[75] Inventors: Robert W. Brush, Sr., Unadilla; R. Amelia Piscitelli, Sidney, both of N.Y.

[73] Assignee: The Bendix Corporation, Southfield, Mich.

[21] Appl. No.: 353,757

[22] Filed: Mar. 1, 1982

[51] Int. Cl.[3] ..... H01R 43/00

[52] U.S. Cl. ..... 29/876; 29/882; 339/258 R

[58] Field of Search ..... 29/826, 830, 862, 863; 72/368; 339/258 R

[56] References Cited

U.S. PATENT DOCUMENTS

| | | | |
|---|---|---|---|
| 2,450,529 | 10/1948 | Sprigg | 29/876 |
| 2,907,976 | 10/1959 | Damon | 339/258 R |
| 3,081,528 | 3/1963 | Hanna | 29/882 |
| 3,257,636 | 6/1966 | Van Horssen | 339/258 R |
| 3,740,839 | 6/1973 | Otte et al. | 29/830 |
| 3,842,497 | 10/1974 | Kehl et al. | 29/862 |
| 4,275,948 | 1/1981 | Gallusser et al. . | |
| 4,365,412 | 12/1982 | Marsh | 29/863 |

FOREIGN PATENT DOCUMENTS

| | | | |
|---|---|---|---|
| 1261012 | 1/1972 | United Kingdom | 29/882 |

*Primary Examiner*—Howard N. Goldberg
*Assistant Examiner*—Carl J. Arbes
*Attorney, Agent, or Firm*—Raymond J. Eifler; Charles D. Lacina

[57] ABSTRACT

A two piece contact assembly characterized by a method of making the assembly by press fitting a stamped and formed inner sleeve (10) into a cold drawn tubular member (20) to provide an electrical contact having a seamless pin type contact area.

1 Claim, 4 Drawing Figures

FIG. 1
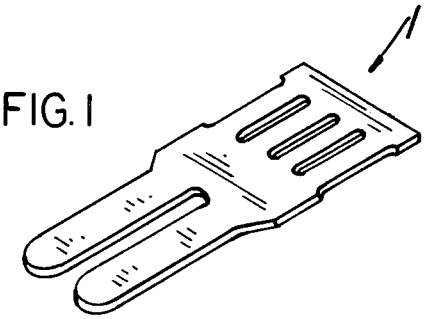
FIG. 2
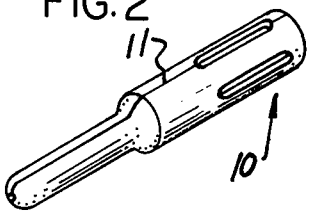
FIG. 3
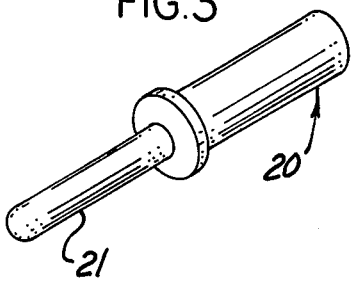
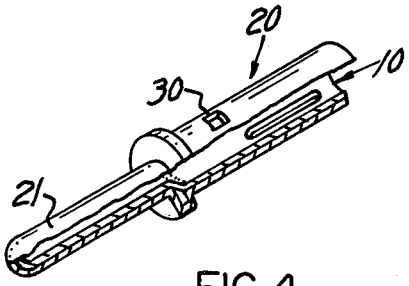
FIG. 4

METHOD OF MAKING A PIN TYPE ELECTRICAL CONNECTOR CONTACT

This invention relates to electrical connectors and more particularly to an electrical contact mounted within a connector.

Electrical connectors generally include a plug and receptacle, each of which have a shell or housing, a plurality of contacts each of which are connected to separate incoming wires, and a dielectric insert assembly for fixedly or removably mounting the electrical contacts within the connector shell. The electrical contacts may be machined from metal shock or stamped and formed from thin sheets of metal. A description of a method of making stamped and formed contacts may be found in U.S. Pat. No. 4,072,394 issued Feb. 7, 1978, entitled "Electrical Contact Assembly"; U.S. Pat. No. 4,120,556 issued Oct. 17, 1978, entitled "Electrical Contact Assembly"; and U.S. Pat. No. 4,262,987 issued Apr. 21, 1981, entitled "Electrical Connector". Stamped and formed contacts are less expensive to make than contacts machined from a solid piece of metal. However, stamped and formed pin contacts, because of the nature of the process, will have a seam the full length of the contact, sometimes resulting in poor crimpability, engagement characteristics and, durability. In addition, state-of-the-art metal cold drawing technology is limited to single thickness pin type contacts with a thickness less than 0.0127 centimeters (0.005 inches).

DISCLOSURE OF THE INVENTION

This invention is a two piece contact assembly characterized by a method of making the assembly by press fitting a stamped and formed inner sleeve into a cold drawn tubular member to provide an electrical contact having a seamless pin type contact area and a concentric wire receiving portion.

Accordingly, one advantage of this invention is that the cold drawn outer tubular member provides a seamless contact surface and the stamped and formed inner sleeve provides increased strength in the pin area and an increased wall thickness in the wire receiving portion of the contact which prevents cracking of the crimp portion of the contact.

Another advantage of this invention is that it can reduce the amount of gold used in the contact by preplating the metal from which the cold formed outer tubular member is formed.

DETAILED DESCRIPTION OF THE INVENTION

FIGS. 1 and 2 illustrate how the inner sleeve is stamped and formed from a sheet of metal.

FIG. 3 illustrates how the outer tubular member is cold formed.

FIG. 4 illustrates an electrical contact assembly incorporating the principles of this invention.

Referring now to the drawings, FIGS. 1 and 2 illustrates an inner sleeve 10 of a contact assembly which is stamped and formed from a sheet 1 of beryllium copper material having a wall thickness of about 0.0127 centimeters (0.005 inches). In one type of contact the inner sleeve 10 has an axial seam 11 and a maximum diameter of about 0.012 centimeters (0.048 inches) and is about 1.267 centimeters (0.491 inches) long. The inner sleeve 10 when initially stamped and formed may be a socket type assembly, a socket type contact, or a pin type contact. If a pin type contact is being fabricated the contact will include a closed end or pin type portion, an enlarged annular intermediate portion, and a rear wire receiving portion. If a socket contact is being formed, the forward portion of the inner sleeve 10 would have a plurality of spring fingers that would form the mating portion of the socket contact for receiving a male pin type electrical contact.

FIG. 3 illustrates a tubular member 10 cold drawn from a metal such as a copper alloy. The cold drawn tubular member 20 may include a gold plating 21 thereon to provide good electrical current carrying characteristics.

FIG. 4 illustrates an electrical contact assembly having an inner stamped and formed sleeve 10 press fit into the outer tubular member 20. The contact assembly is assembled by press fitting the stamped and formed sleeve 10 into the outer tubular member 20. A combination wire stop and inspection hole 30 is then punched through both members 10 and 20.

While a preferred embodiment of this invention has been disclosed, it will be apparent to those skilled in the art that changes may be made to the invention as set forth in the appended claims, and in some instances, certain features of the invention may be used to advantage without corresponding use of other features. For instance, the gold plating may not be placed on the outer portion of the tubular member 20 and a gold plating may be placed on portions of the inner sleeve 10. Further, the inner sleeve may or may not have an enlarged middle portion but may be attached to the cold drawn sleeve which would have an enlarged middle portion for retaining the contact within the connector insert. Accordingly, it is intended that the illustrative and descriptive materials herein be used to illustrate the principles of the invention and not to limit the scope thereof.

Having described the invention what is claimed is:

1. A method of making a two piece pin type electrical connector contact comprising the steps of:

stamping from a sheet of metal a rectangular shaped piece;

forming said rectangular piece into a sleeve having an axial opening running the entire length of said sleeve, a rear open end portion and a forward closed end pin shaped portion, the diameter of the opened end portion being greater than the diameter of the closed end portion of said sleeve;

cold drawing from a piece of metal a tubular member having a rear open end portion, an enlarged middle portion having a forwardly facing shoulder and a rearwardly facing shoulder, and a forward closed end pin shaped portion, said diameters of said forward and rear end portions of said tubular member being slightly less than the respective diameters of said forward and rear end portions of said sleeve;

radially compressing said sleeve so that the axial opening in said sleeve is reduced, thereby reducing the diameter of the forward and rear portions of said sleeve;

inserting said sleeve into said tubular member so that the closed end portion of said tubular member surrounds the closed end portion of said sleeve; and punching a wire stop and inspection hole through said sleeve and member in the open end portions thereof.

* * * * *